US005201855A

United States Patent [19]

Ikola

[11] Patent Number: 5,201,855

[45] Date of Patent: Apr. 13, 1993

[54] GRID SYSTEM MATRIX FOR TRANSIENT PROTECTION OF ELECTRONIC CIRCUITRY

[76] Inventor: Dennis D. Ikola, 2866 Lakeshore Ave., Maple Plain, Minn. 55359

[21] Appl. No.: 768,379

[22] Filed: Sep. 30, 1991

[51] Int. Cl.[5] ..... H01R 13/648

[52] U.S. Cl. ..... 439/608; 439/620

[58] Field of Search ..... 439/620-622, 439/607, 608; 333/181-185

[56] References Cited

U.S. PATENT DOCUMENTS

| | | | |
|---|---|---|---|
| 2,577,120 | 12/1951 | Franz . | |
| 3,671,812 | 6/1972 | Peluso et al. . | |
| 3,790,858 | 2/1974 | Brancaleone et al. . | |
| 3,940,665 | 2/1976 | Seki . | |
| 4,500,159 | 2/1985 | Briones et al. | 439/620 |
| 4,572,600 | 2/1986 | Nieman . | |
| 4,582,385 | 4/1986 | Couper et al. . | |
| 4,600,262 | 7/1986 | Nieman et al. . | |
| 4,616,101 | 10/1986 | Veerman et al. . | |
| 4,747,789 | 5/1988 | Gliha | 333/185 |
| 4,791,238 | 12/1988 | Kanno et al. . | |
| 4,820,174 | 4/1989 | Farrar et al. | 439/620 |
| 4,868,712 | 9/1989 | Woodman . | |
| 4,929,196 | 5/1990 | Ponn et al. . | |
| 5,023,577 | 6/1991 | Drake . | |
| 5,057,041 | 10/1991 | Yu et al. | 439/620 |
| 5,066,931 | 11/1991 | Thelissen | 439/620 |

*Primary Examiner*—David L. Pirlot
*Attorney, Agent, or Firm*—Haugen and Nikolai

[57] ABSTRACT

A compact EMP and EMI/RFI connector protection module insertable into a connector receptacle forming a portion of a sealed electrical enclosure. The protection modules include a plurality of electrical filters each protecting a pin such as a 300 plus pin ARINC 600 connector standard on aircraft electronic enclosures or boxes. The modules comprise a conductive lattice or grid having a plurality of orifices defined by facing walls. Unpackaged integrated circuit dies are bonded to the walls defining the orifices and are electrically coupled to inserted contact pins via spring clips inserted therebetween. A conductive path exists from the pins to the conductive lattice, forming a ground plane and a heat sink, via the unpackaged integrated circuit die, a conductive strip and spring clip. The module is sufficiently compact providing electrical protection to selected pins on 0.1 inch centers.

19 Claims, 7 Drawing Sheets 10
34
36
20
16
28
22
24
33
33
16
12
14
32
21
18
19
20
30
26

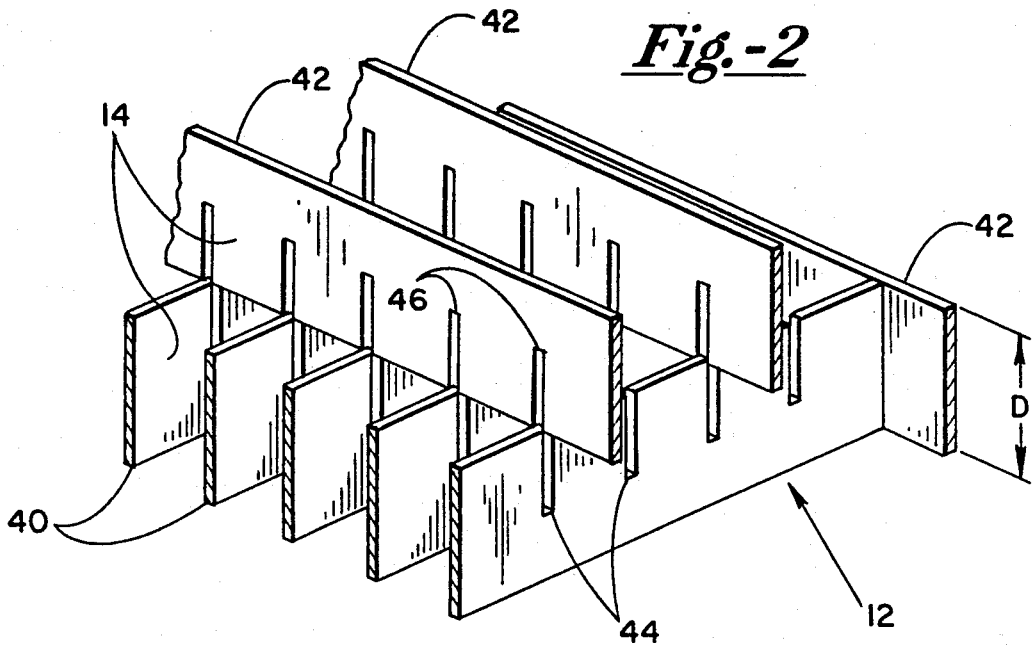
Fig.-2
Fig.-3
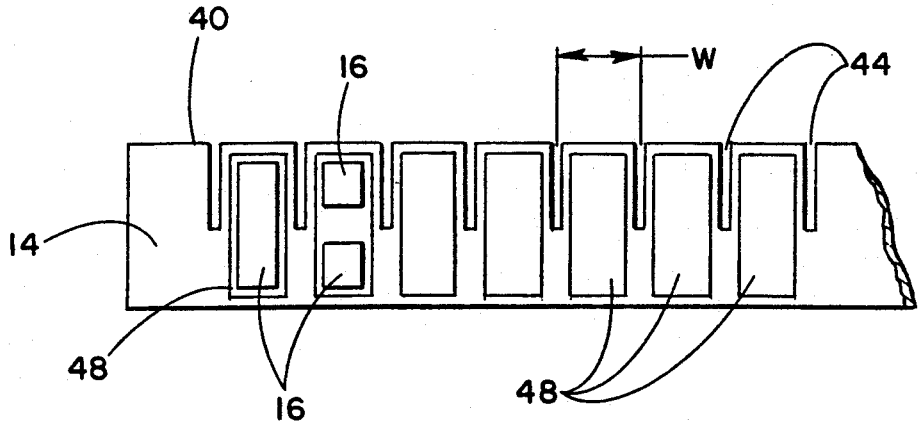

GRID SYSTEM MATRIX FOR TRANSIENT PROTECTION OF ELECTRONIC CIRCUITRY

BACKGROUND OF THE INVENTION

I. Field of the Invention

This invention relates generally to electrical connectors for connecting electrical assemblies or parts to a cable harness, and more particularly to a connector module assembly insertable into a receptacle of the electrical assembly incorporating active and passive circuit elements for effectively isolating the electrical assembly from electromagnetic interference (EMI), radio frequency interference (RFI), and electromagnetic transient pulses (EMP).

II. Discussion of the Prior Art

Present-day commercial and military aircraft incorporate complex electronic control systems incorporating numerous sensors and force transducers as well as the electronics necessary for processing the sensor signals and developing the requisite control signals for the transducers so that the aircraft can be flown in a controlled manner. Typically, the electronic assemblies involved will be housed in metallic shielding enclosures or boxes which are adapted to slide into equipment racks on the aircraft. Each of the electronic assemblies will typically incorporate a plug receptacle having a large number of terminal pins arranged in a grid configuration and which are appropriately wired to the electronic componentry within the shielded enclosure. Incorporated into the equipment rack assembly is a plug member which is adapted to mate with the plug receptacle on the shielded enclosure housing. The pins of the plug member are typically connected to conductors in a wiring harness leading off to the sensors and control transducers which may be spread throughout the aircraft.

A standard plug used throughout the aircraft industry is referred to as the ARINC 600 plug, which meets the ARINC specifications for air transport avionics equipment interfaces. That specification, among other things, defines the number of pins, their location, the pin spacing and the shell dimensions for the plug. Those desiring specific information relative to the plug are referred to the ARINC 600 specification itself.

The ARINC 600 plug is designed to mate with a plug receptacle attached to or formed into a wall of the shielding enclosure in which the electronics are contained. The ARINC 600 plug receptacle includes three sections with sections A and B each incorporating 150 male pins, each disposed in a grid array of rows and columns. Section C includes a smaller number of pins which, generally speaking, provide the power connections to the electronics module. The existing plug receptacle, designed to receive the plug member, includes a plurality of terminal pins having female sockets on one end and male wire wrap terminals or solder points on the other end. The pins are arranged in the same grid array, such that when the plug member is inserted into the plug receptacle, the male pins of the plug member engage the female sockets of the receptacle's terminal pins. The male portion of the receptacle's terminal pins are connected via wiring to electronic circuitry within the shielded enclosure.

The above-described prior art plug/receptacle combination has a number of inherent drawbacks. First of all, the prior art ARINC 600 connector design does not provide the necessary immunity of the electronic circuitry from the detrimental effects of EMI, RFI and EMP. Thus, for example, a lightning strike near the aircraft may induce a high voltage transient pulse (EMP) into the conductors of the wiring harness in the aircraft. Such transient pulses are oftentimes of an amplitude that can destroy CMOS circuitry forming a part of the electronic circuitry with which the ARINC 600 receptacle is interfaced to. Similarly, EMI and RFI radiation in proximity to the shielded enclosure may find a path into the interior of the shielded enclosure via the plug/receptacle assembly. These RFI/EMI and EMP sources may result in the electronic controls issuing erroneous data to the transducers with which it is associated, resulting in loss of control over the aircraft.

While filtering and transient suppression circuits have been devised for dealing with RFI/EMI and EMP radiation, physical space constraints may preclude inclusion of such circuitry within the shielded enclosure. A need, therefore, exists for a protection module insertable between and compatible with existing plugs and receptacles. A protection module which is sufficiently small to interface with existing plugs/receptacles yet which sufficiently protects electronics circuitry from EMI/RFI/EMP is desirable.

There is disclosed in the Paul et al. U.S. Pat. No. 4,789,360 and the Morse et al. U.S. Pat. No. 4,746,310, each assigned to Amphenol Corporation, electrical connectors having transient suppression discrete components incorporated therein. Moreover, the connector is designed such that the contact pins have mating forward and rearward end portions and a medial portion which includes a circuit protection element in the form of a packaged silicon diode or varistor. Because of the manner in which the connector pins are designed, it is possible to remove the forward end portion to allow repair or replacement of the circuit protection component. The physical size of the packaged silicon diode and its mode of attachment to the connector pin drastically limits the number of pins that can be arranged in the connector. Thus, the approach disclosed in those two Amphenol Corporation's patents is impractical in implementing a EMI/RFI/EMP connector receptacle compatible with the existing ARINC 600 plug having 2 sets of 150 pins/connector arrays.

OBJECTS

It is accordingly a principal object of the present invention to provide an improved compact and versatile protection module which can mate with an industry standard plug and is receivable within an industry standard receptacle and which incorporates circuitry for attenuating and limiting various forms of electromagnetic radiation from seriously affecting the operation of the control electronics.

Another object of the invention is to provide an improved protection module containing a large plurality of terminal pins which will mate with an industry standard plug and receptacle and in which EMP (lightning and nuclear) protection and EMI/RFI are effectively filtered, wherein the protection module will still fit in the space allocated for it and the plug in the receptacle of the equipment enclosure.

SUMMARY OF THE INVENTION

The foregoing features and objects of the invention are achieved by providing a compact electrical protection module receivable into a recessed connector receptacle of an electronic enclosure to provide attenuation of EMI and RFI noise and EMP. The module comprises a lattice arrangement of intersecting conductive strips defining a plurality of rectangular orifices. Each orifice is surrounded by a plurality of inner walls of the lattice. A plurality of integrated circuit dies, each having a bonding surface, are coupled to selected predetermined inner walls. A plurality of contact pins are disposed in the orifices. Conductive means are disposed in respective orifices populated with integrated circuits and establish an electrical path from the contact pin to the conductive lattice via at least one uncased integrated circuit die. A conductive housing encompasses and is coupled to a periphery of the conductive lattice and forms a heat sink and ground plane in conjunction with the conductive lattice.

To provide EMP immunity, the EMP module incorporates transient voltage suppression devices as the integrated circuit dies which are operatively coupled between selected ones of the contact pins and the conductive strips forming the lattice for creating an active barrier between transient spikes induced in the wiring harness of the aircraft and the electronic apparatus contained within the shielding box or enclosure. Selected ones of the pins in the EMP module may also include a fusible link for preventing potentially damaging current levels from entering the electronics module.

To provide EMI/RFI immunity, the EMI/RFI module incorporates capacitors as the integrated circuit dies, and a ferrite bead is physically disposed as a sleeve around the pin and operatively coupled to the capacitors to provide an LC filter. This LC filter shunts EMI/RFI high frequency components conducted via the respective adjacent pin to ground to effectively prevent electronic noise from entering or leaving the electronic enclosure.

In that the EMP and EMI/RFI filter modules are each very compact to protect in excess of 150 pins in a small area, and are insertable into the receptacle disposed exterior to the enclosure chassis, more room is available within the enclosure for functional electronics. Further, the modules are easily accessible, removable and replaceable from the front of the connector receptacle such that the enclosure, which is usually RF sealed by a weld, does not require opening to repair EMP and EMI/RFI circuitry. This greatly reduces down time of expensive and critical apparatus in which the electronics assembly is used. Finally, the circuitry is relatively inexpensive and reliable allowing the modules to be economically disposable.

The foregoing features, objects, and advantages of the invention will become apparent to those skilled in the art from the following detailed description of a preferred embodiment, especially when considered in conjunction with the accompanying drawings in which like numerals in the several views refer to corresponding parts.

BRIEF DESCRIPTION OF THE DRAWINGS

FIG. 2 shows an exploded view showing a portion of the conductive strips comprising the lattice which forms a ground plane and heat sink;

FIG. 3 shows one conductive strip forming a portion of the conductive lattice and assembled with unpackaged integrated circuit dies;

DESCRIPTION OF THE PREFERRED EMBODIMENT

The invention is explained herein by means of a description of the preferred embodiment. Those skilled in the art will understand that the description is intended to be by way of illustration and not limitation of the invention and that alternative means may be employed to carry out the invention.

Figure 1:
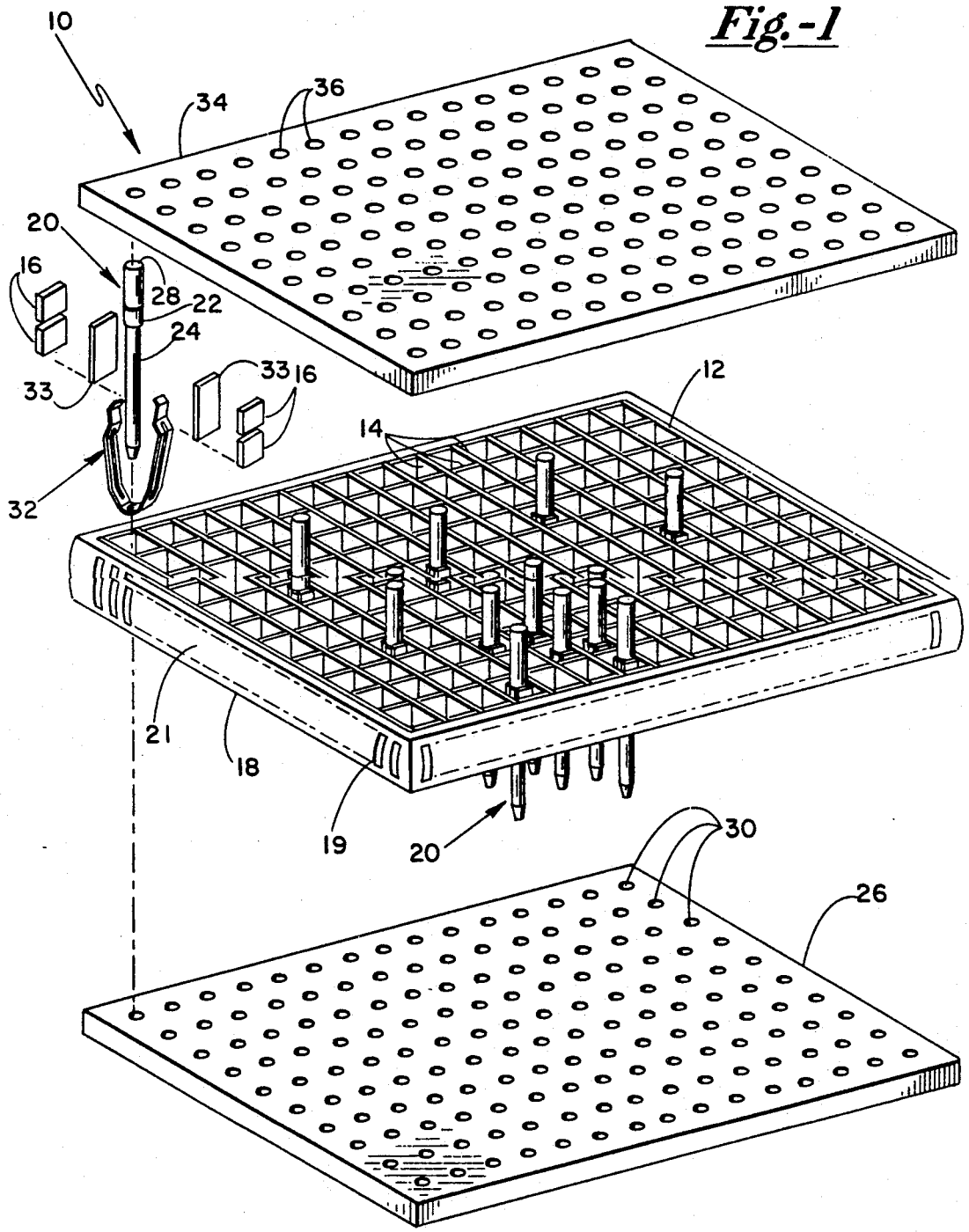
FIG. 1 shows a partially exploded view of a protection module as provided by the invention.

FIG. 1 is an exploded view of an electrical connector protection module 10 insertable into a connector plug receptacle disclosed in the cross-referenced application. Module 10, when assembled, comprises a generally rectangular block incorporating a metal conductive lattice or grid 12 having a plurality of orifices defining mutually perpendicular facing surfaces 14. One or more integrated circuit components or dies 16, in an unpackaged form, are selectively disposed on the facing walls 14 such that common mating surfaces between the dies and the lattice provide a low electrical impedance and high thermal conductive interface. A thermally and electrically conductive housing 18 is connected, such as by soldering, around a periphery of conductive lattice 12 to form a heat sink and ground plane in combination with conductive lattice 12. Housing 18 is louvered having a plurality of parallel and vertical slots 19 forming a compressible surface for engaging the conductive connector shell of the receptacle it is inserted into. A plurality of electrical contact pins 20 having integral component segments 22 are longitudinally disposed in selected orifices defined by conductive lattice 12. Each pin 20 has a cylindrical male portion 24 extending a predetermined distance beyond a first major or bottom conductive substrate 26, and a tubular female portion 28 adjacent component segment 22 and having a larger diameter than the male portion 24. The inner diameter of the tubular female portion 28 forms a socket for receiving a male portion of other connector pins, either on another protection module or on a mating connector plug. Bottom substrate 26 is comprised of a plate-like, thermally conductive and electrically insulative ceramic material having a plurality of generally circular openings 30 on the same center-to-center spacing as the orifices for receiving male portions 24 of pins 20 with a friction fit. The circular openings 30 and pins 20 are spaced in accordance with the same grid pattern used for the terminal pins on the plug receptacle into which modules 10 of the present invention are inserted. A conductive metal leaf spring member 32 is physically coupled to selected pins 20 and is disposed in each of the orifices populated with dies 16 to provide an electrical connection between a rectangular metal and plate-like conductive strip 33 and the mating electrical pins 20. Leaf spring member 32 is shaped to press firmly against both an outer surface of each conductive strip 33 and pin 20 when pin 20 is inserted through spring member 32 and inserted within an orifice of grid 12 to provide a good mechanical and thermal contact between IC chip 16 and pin 20. A thermally conductive and electrically insulative ceramic top cover or substrate 34, similar to bottom substrate 26, forms a second major surface of module 10 and it too has a plurality of generally circular openings 36 which are larger in diameter than openings 30 of bottom surface 26. Substrate 34 is disposed over upper female socket portions 28 of pins 20 such that the top of each female socket portion 28 is substantially flush with cover 34. Cover 34 is bonded to connector housing 18 such as by using a conductive epoxy adhesive. The conductive path formed by the combination of an electrical pin 20, component segment 22, spring member 32, conductive strip 33, die 16 and conductive lattice 12 provides an electrical circuit that can be custom configured as will be described below. Each inserted pin 20 can cooperate with one or more dies 16 affixed to an adjacent inner surface 14 via conductive strip 33 and spring member 32 to provide redundant, multiple and/or tandem paths between pin 20 and conductive lattice 12.

Referring to FIG. 2, conductive lattice 12 comprises a plurality of substantially parallel conductive plate members or strips 40 intersecting generally perpendicularly to a further plurality of substantially parallel conductive plate members 42 in "egg-crate" fashion. Both conductive members 40 and 42 are each comprised of a low electrical impedance and high thermally conductive material such as beryllium copper (BeCu). Each of the conductive members 40 and 42 include a plurality of transverse and parallel notches or slots 44 and 46, respectively, each spaced a predetermined distance apart and extending approximately half-way through the width dimension of the respective strips. Slots 44 and 46 intersect each other in an interference fit to form generally rectangular conductive lattice or grid 12 having a depth "D". Lattice 12 forms both a heat sink for heat dissipating components and a ground plane. Lattice 12 also provides pin-to-pin physical isolation between adjacent pins 20. Conductive members 40 and 42 may be formed to create other, more complex conductive lattice patterns, such as a honeycomb or hexagonal design, providing more than four surfaces per orifice for locating additional dies 16; hence, lattice 12 is not strictly limited to the preferred rectangular configuration that is illustrated.

Referring to FIG. 3, each conductive member 40 and 42 serves as a substrate and includes a plurality of interface regions 48 between adjacent slots 44 and 46 on strips 40 and 42, respectively. Interface or die bonding regions 48 are plated with a conductive material such as nickel or silver to provide a low impedance and high thermal conductive mating surface. Prior to assembly of conductive members 40 with conductive members 42 to form lattice 12, uncased integrated circuit dies 16 are selectively positioned and affixed to interface regions 48, such as by using automatic pick and place equipment, and ultrasonic bonding, vapor-phase, or IR techniques well known in the industry. To realize high density packing of electrical protection module 10, slots 44 and 46 in the present invention may be on 0.1 inch centers, as shown by dimension W, but limitation to such spacing is not to be inferred. Most electronic components have a commonality of having a die form prior to packaging. This unpackaged die form exhibits a small surface area and allows placement of several components in a small area due to the low thickness profile and small size. Therefore, a large variety and number of circuits can be designed to cooperate with a pin in a very small location.

Figure 4:
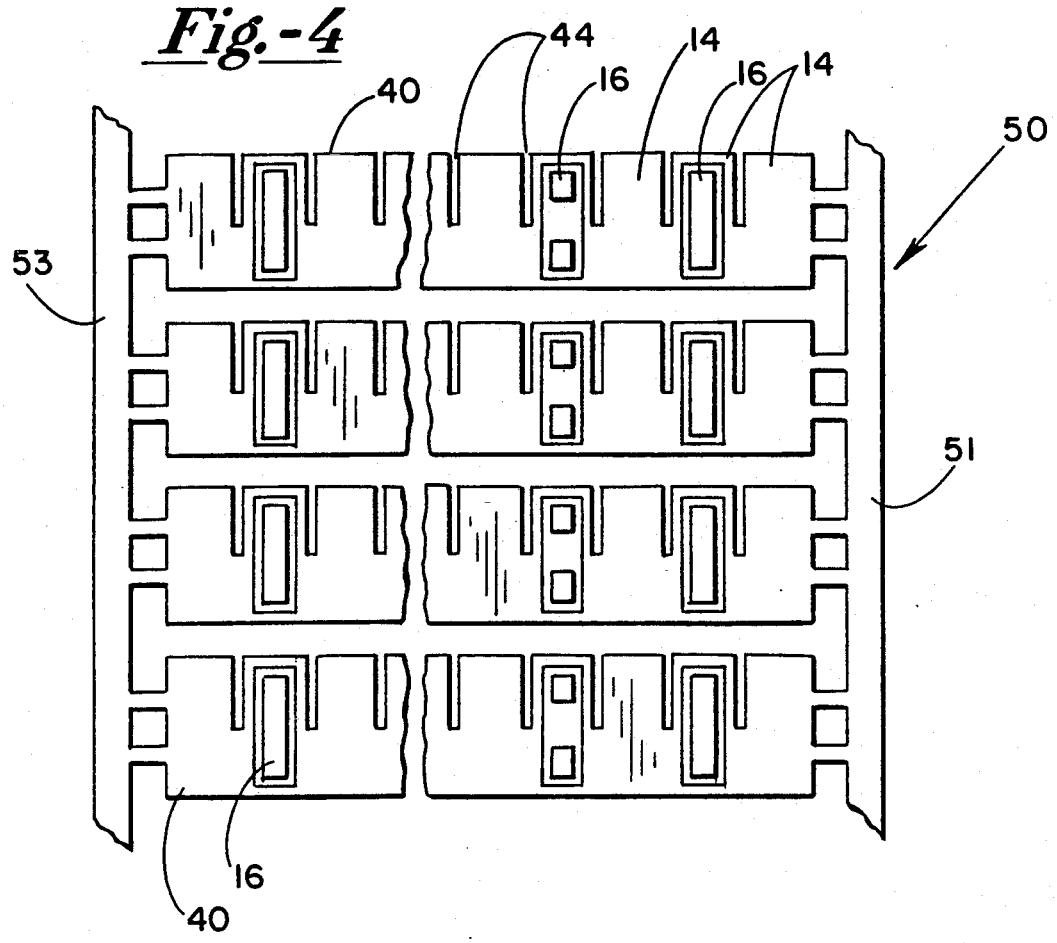
FIG. 4 shows a plan view of a fabrication stage of the conductive strips before being assembled as the lattice but after being populated with unpackaged integrated circuit dies.

Electronic protection module 10 lends itself easily to manufacturing as conductive members 40 and 42 may be formed in sheets 50 in a stamping process as shown in FIG. 4. Sheet 50 includes a plurality of conductive strips 40 and 42 supported at each end by transversely extending ribs 51 and 53. Each sheet 50 can be maintained intact through creation of the bonding areas and the attachment of dies 16 for simplicity, efficiency and to realize low manufacturing costs. Testing may also be accomplished using a conventional multiple probe test system while conductive members 40 and 42 are still in a sheet form. Hence, component replacement or repairing is easily and conveniently accomplished. Optional burnin or other reliability requirements of IC dies 16 can be ascertained at this state as well. After these manufacturing and testing steps have been performed, the strips can be snapped free of ribs 51 and 53 and assembled into the lattice configuration.

Figure 5:
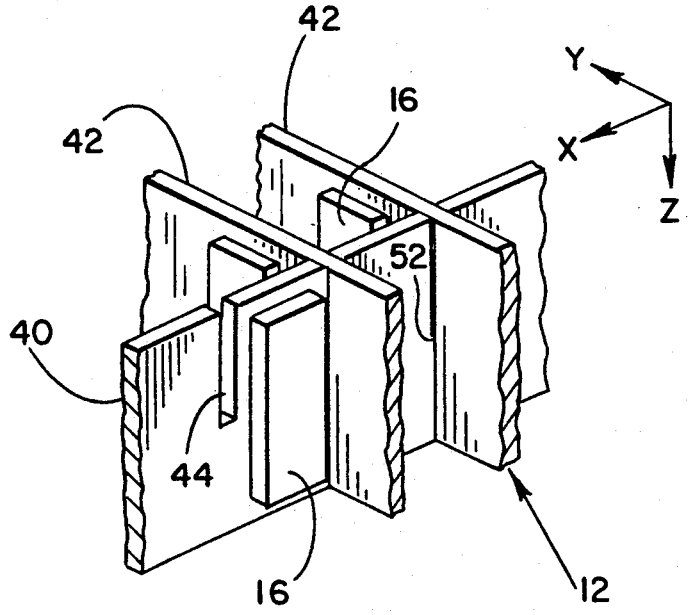
FIG. 5 shows a cut-away view of a portion of the module.

Referring next to FIG. 5, a cut-away perspective view of a portion of EMI/RFI protection module 10 is shown. As illustrated, integrated circuit dies 16 are affixed to inner facing surfaces 14 of conductive member 40. Space in the X-Y direction is limited in accordance with a desired pin spacing, but may be significantly greater allowing one or more IC dies 16 to fit in the less space-limited Z direction. Lattice 12 can also be spot welded at intersection 52 of intersecting slots 44 and 46 to obtain a more reliable joint. Dipping lattice 12 into solder prior to insertion of pins 20 can also provide a more reliable and conductive intersection 52 and can facilitate bonding of IC dies 16 in a solder reflow process.

Figure 6:
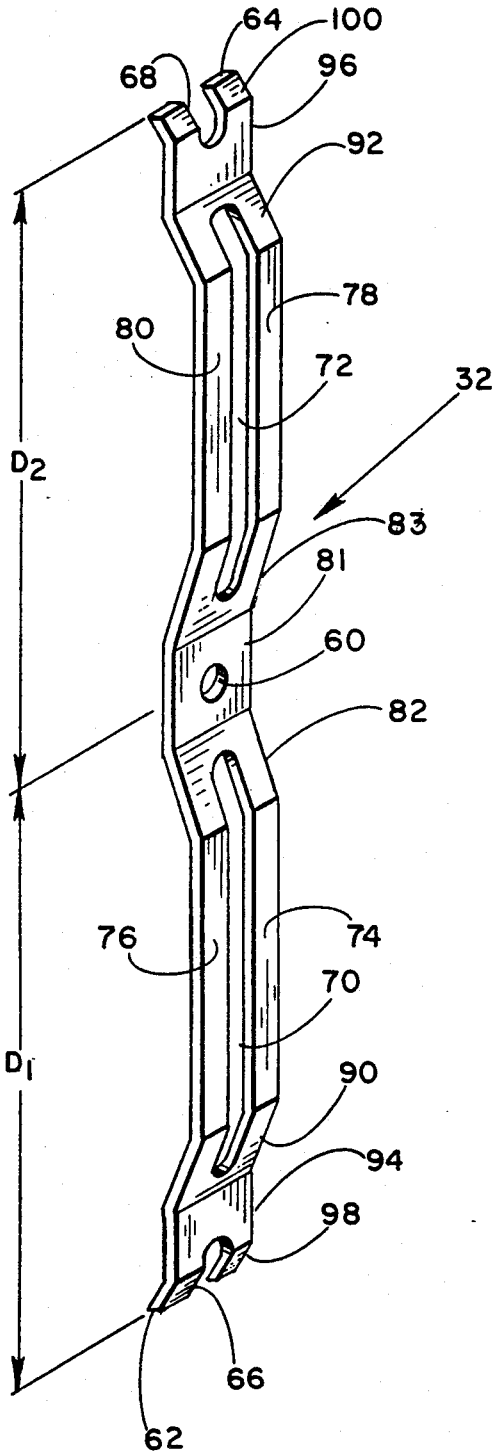
FIG. 6 shows a perspective view of a first stage of preforming the spring member.

Now referring to FIG. 6, a perspective view of rectangular and plate-like spring member 32 is illustrated to show a first stage of pre-forming spring member 32. Spring member 32 has a circular opening 60 centrally located at a midsection and defined slightly offset in the longitudinal direction from the exact center between distal ends 62 and 64. Distance $D_1$, which is defined between opening 60 and distal end 62, is slightly greater than distance $D_2$, which is defined between opening 60 and distal end 64, as will be described shortly. A pair of semicircular recesses or notches 66 and 68 which conform to the circumference of pin 20 are defined at distal ends 62 and 64, respectively, such that each notch 66 and 68 opens outward and away from opening 60. A pair of elongated openings 70 and 72 are defined between opening 60 and respective distal ends 62 and 64. Elongated opening 70 bifurcates a portion of spring member 32 to define a pair of elongated contact surfaces 74 and 76, and elongated opening 72, similarly, defines a pair of elongated contact surfaces 78 and 80. The width of openings 70 and 72 is generally equal to the width of recesses 66 and 68, such that defined contact surfaces 74, 76, 78 and 80 are each sufficiently narrow and flexible to function as leaf-springs as will be described shortly.

Initially, spring member 32 is formed by machine stamping out of sheet metal. Next, spring member 32 is pre-formed to define contours as shown. Spring member 32 has a center section 81 and a pair of adjacently located tapered sections 82 and 83 each tapering at an acute angle from a plane defined by center section 81 to respective contact surfaces 74, 76, 78 and 80 which are each offset and parallel to the plane defined by center section 81. A pair of tapered sections 90 and 92 each taper from respective contact surfaces 74, 76, 78 and 80 back toward the plane defined by center section 81 at an acute angle to a pair of sections 94 and 96. Sections 94 and 96 each taper away from the plane defined by center section 81 at an acute angle as shown. Finally, a pair of distal segments 98 and 100 each taper from respective sections 94 and 96 back toward the plane defined by center section 81 at an acute angle and terminate at distal ends 62 and 64, respectively.

Figure 7:
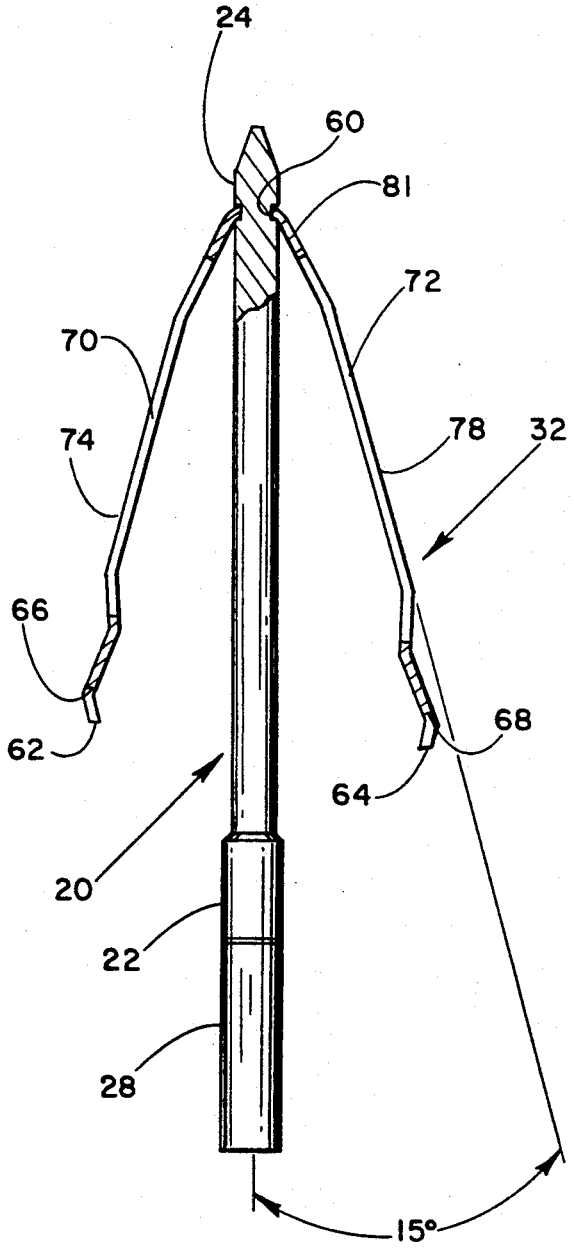
FIG. 7 shows, a profile view of a spring member coupled to a pin illustrating a second stage of pre-forming the spring member to 15 degrees off the axis of the pin.

Now referring to FIG. 7, a second stage of pre-forming spring member 32 is illustrated. Male portion 24 of pin 20 is inserted through opening 60 of spring member 32 in a normal orientation in an interference fit from below spring member 32 such that distal ends 62 and 64 of spring member 32 are tapered downward. Contact surfaces 74, 76, 78 and 80 are each bent downward toward the arcuate surface of male portion 24 of pin 20 such that each recess 66 and 68 of spring member 32 faces toward male portion 24 of pin 20. Each contact surface 74, 76, 78 and 80 is formed in approximately a 15-degree angle from the axis defined by pin 20 such that each contact surface 74, 76, 78 and 80 has a leaf-spring characteristic when recesses 66 and 68 are biased toward pin 20 due to respective openings 70 and 72 and the first stage pre-forming previously described. Spring member 32 is preferably comprised of a metal such as beryllium copper (BeCu) having very good spring retention characteristics as well as high electrical and thermal conductivity characteristics.

Figures 8, 9:
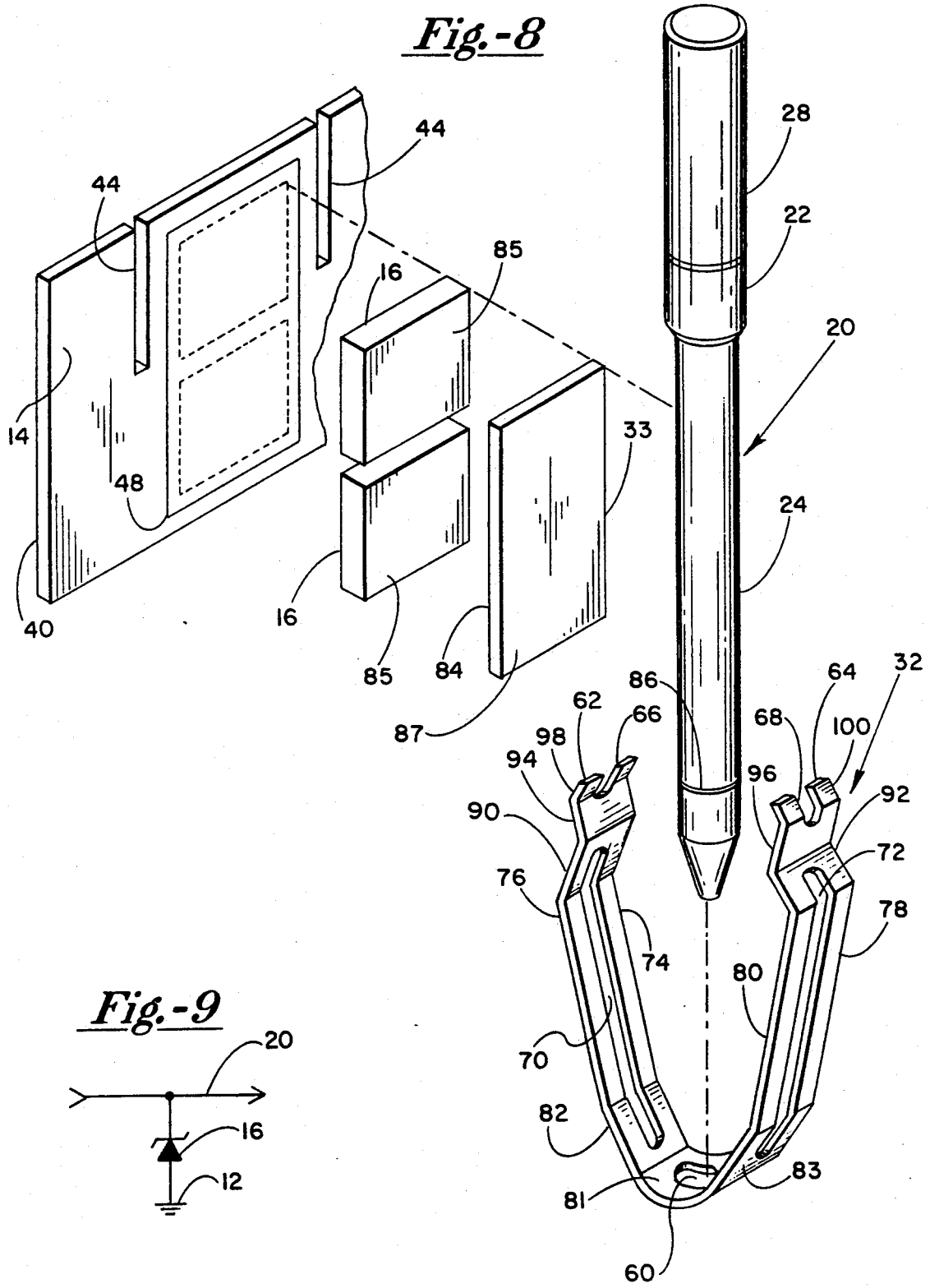
FIG. 8 shows an exploded perspective view of a portion of the conductive lattice with an inserted pin.
FIG. 9 shows a schematic representation of an overvoltage circuit as realized by the invention.

Now referring to FIG. 8, an exploded perspective view of an overvoltage and transient protection circuit coupled to a selected pin 20 in module 10 is shown. Interface or bonding region 48 of inner surface 14 of conductor strip member 40 receives two integrated circuit dies 16, each comprising diodes. A major bottom surface 84 of rectangular and plate-like conductive strip 33 is bonded to a top surface 85 of each integrated circuit die 16 by spot welding, soldering or other methods. Opening 60 defined in conductive spring member 32 is axially slid over male portion 24 of pin 20 such that a shallow and narrow continuous groove 86 defined about a circumference of male portion 24 of pin 20 nearly proximate the tip receives a rim of opening 60 for alignment. Preferable dimensions of a diameter of 0.020 inches for male portion 24, 0.022 inches diameter for opening 60, and 0.001 inches for a depth of groove 86 have been found to produce excellent results, but limitation to these dimensions is not to be inferred. A substantial length of each contact surfaces 74 and 76 of spring member 32 is made to abut a substantially flat aligned top major surface 87 of conductive strip 33 such that each contact surface 74, 76, 78 and 80 is mechanically urged thereupon to form a good electrical and good thermal contact. Conductive strip member 40 forming a portion of lattice 12 serves as a ground plane and a heat sink to provide a voltage reference and to sink current during an overvoltage condition.

In the preferred embodiment, each integrated circuit dies 16 may comprise zener diodes constructed in a parallel configuration as shown schematically in FIG. 9. Hence, an electrical path is established from pin 20 via spring member 32, conductive strip 33 and die 16 to conductive lattice 12 to provide an overvoltage protection circuit, thus protecting other circuits which are joined to the connector receptacle with which module 10 is used from overvoltage and transient conditions created by EMP generated by lightning or a nuclear blast.

Module 10 can be custom configured to realize other designs for providing overvoltage and transient protection to selected pins 20 by selectively populating a plurality of integrated circuit dies 16 on inner surface 14 adjacent pins 20 in the manner described. This allows the overall module 10 to be custom designed to provide protection from transient overvoltage or an electromagnetic pulse (EMP) to preselected pins 20. The number of integrated circuits that can be bonded to conductive lattice 12 is governed by the surface area of integrated circuit dies 16 that are currently available using existing technology. Therefore, as technology continues to reduce the size of integrated circuit dies, more dies 16 in excess of two per inner surface 14 can be affixed to inner surfaces 14 per unit area. Creative placement of multiple dies 16 on lattices 12 having more than four inner surfaces 14 can also allow unique combinations of circuits to be realized.

Figure 10:
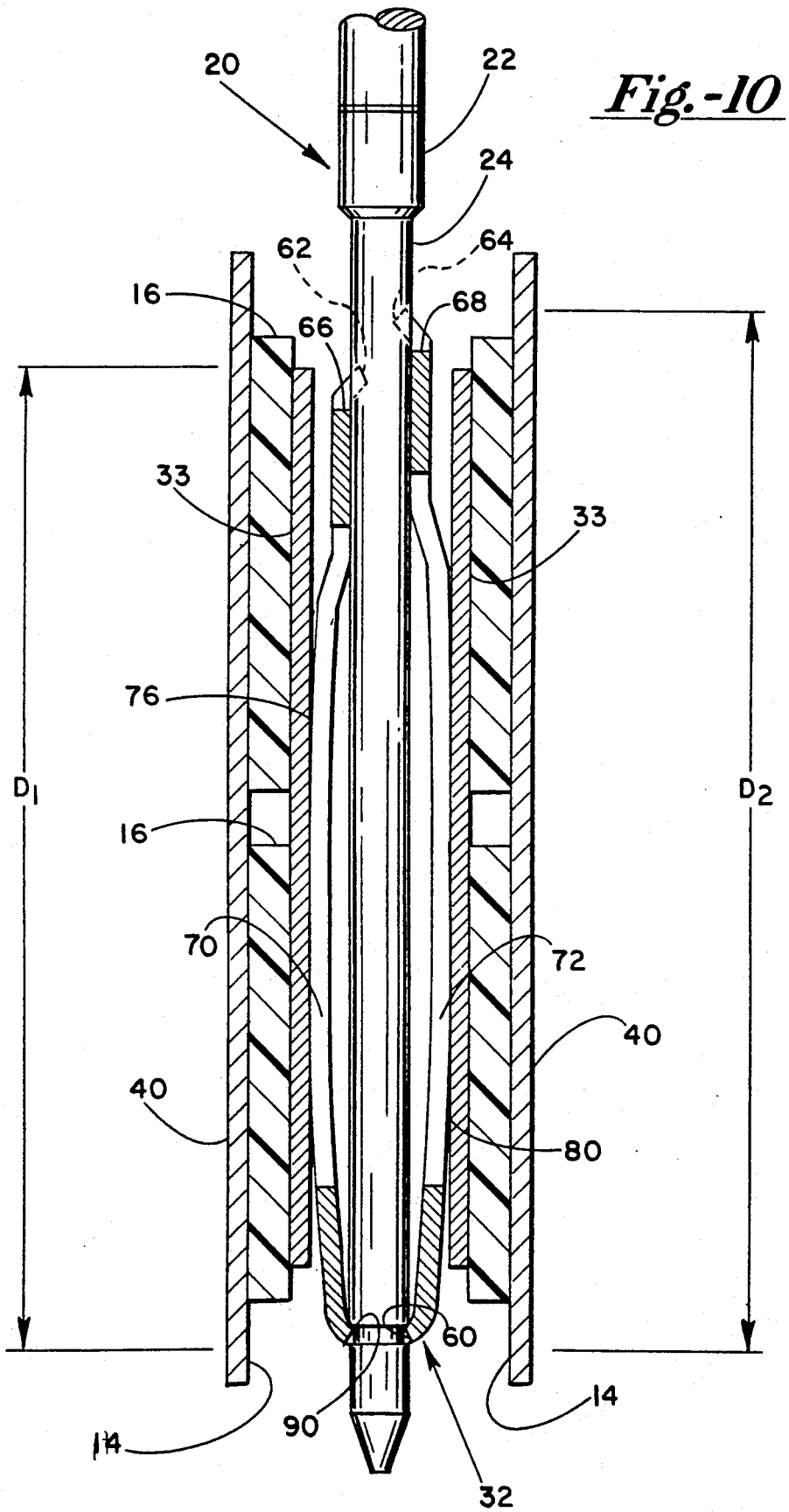
FIG. 10 shows a profile of a pin received into an orifice defined by the ,conductive lattice.

Referring to FIG. 10, an assembled cross-sectional profile of one pin 20 adapted to a spring clip 32 and inserted into an orifice defined by lattice 12 and populated with integrated circuits 16 is shown. Male portion 24 of pin 20 is disposed opposite female portion 28, wherein male portion 24 and female portion 28 interface with external compatible connectors/pins on other modules, or with mating pins on other connector elements such as male plugs or female receptacles. When a pin 20 is inserted into the orifice, contact surfaces 74, 76, 78 and 80 are each urged toward pin 20 such that each recess 64 and 66 defined in distal ends 60 and 62 of spring clip 32 physically engage pin 20 such that each edge of recesses 64 and 66 bites into pin 20 to provide a good mechanical and thermal contact. As previously discussed in FIG. 6, length $D_1$ is slightly greater than length $D_2$ such that distal ends 62 and 64 are slightly offset from one another when engaging pin 20. Thus, distal ends 62 and 64 do not physically contact or interfere with one another when engaging pin 20. Pin 20 is disposed through opening 60 such that the rim of opening 60 physically engages circular groove 86 defined about a periphery of male portion 24 of pin 20 to properly align spring clip 32 along pin 20. As male portion 24 of pin 20 fits in a close tolerance arrangement with opening 60, when the assembly of pin 20 and spring clip 32 is seated within the orifice of lattice 12 as illustrated in FIG. 10, the edge of opening 60 also bites into pin 20 in groove 86 at point 90 to form a second electrical and thermal contact along with recesses 64 and 66.

Contact surfaces 74, 76, 78 and 80 are each biased against and engage surface 87 of conductive strips 33 to provide a good thermal and electrical contact. Elongated openings 70 and 72 defined in clip 32 ensure each individual contact surfaces 74, 76, 78 and 80 have good leaf-spring characteristics such that if spring clip 32 is slightly offset from a perfect flush contact with conductive strips 33, a substantial portion of each of contact surfaces 74, 76, 78 and 80 still engages surfaces 87 of conductive strips 33. Thus, the preferred design balances maximizing the total surface area between spring clip 32 and surface 87 of conductive strip 33 while obtaining a desirable spring characteristic of spring clip 32 to ensure sufficient contact surface area therebetween even when spring clip 32 is not in a perfect flush contact with conductive strip 33. Conductive strip 33 uniformly engages the top of each integrated circuit 16 to provide uniform electrical and thermal conductivity paths from each integrated circuit 16 to spring clip 32. Conductor strip 33 also equalizes pressure exerted by spring clip 32 against each integrated circuit 16. Thus, the uniform heat transfer characteristics from spring clip 32 to each of the integrated circuits 16 via conductive strip 33 substantially reduces hot spots generated by high wattage components such as thermistors.

In an alternative embodiment, spring member 32 and/or conductive strip 33 can be substituted with a substantially soft conductive metal, such as gold, deposited upon top surface 85 of each die 16 for an interference fit with an inserted pin 20. The substantially soft conductive metal will meld to engage pin 20 to form a good conductive path between pin 20 and die 16. This embodiment is not as durable as spring member 32 and conductive strip 33 for multiple insertions and removals of pin 20 into the orifice defined by conductive lattice 12, but is a viable alternative depending on technical design requirements.

Figure 11:
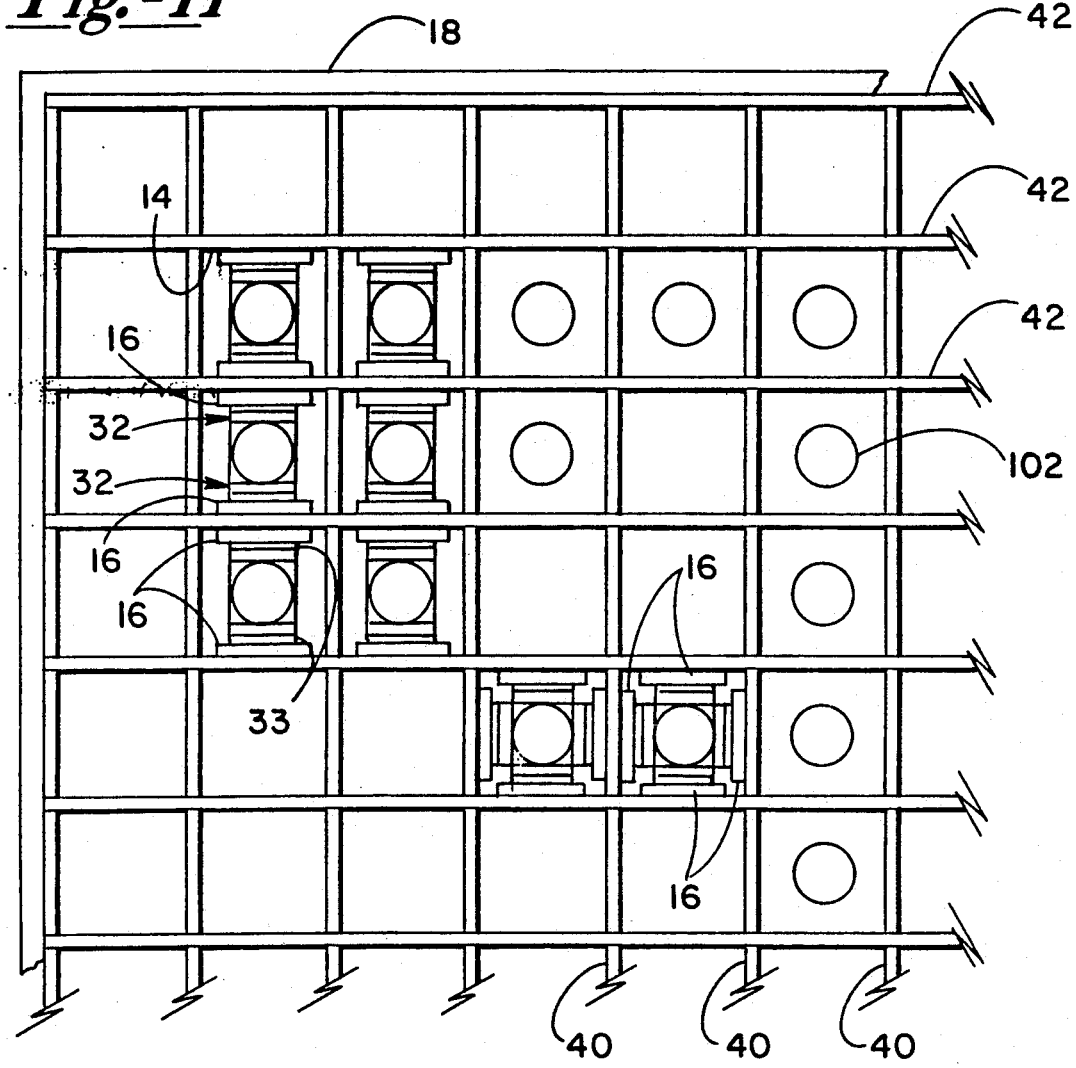
FIG. 11 shows a bottom view of the module according to the invention partially populated with unpackaged integrated circuit dies, conductive strips, spring members and pins.

Referring to FIG. 11, a bottom view of module 10 with the bottom surface 26 removed is shown where preselected inwardly facing surfaces 14 are populated with dies 16 to interface with pins 20 via spring member 32 and conductive strip 33 as previously discussed. Pins 20 not requiring protection, such as pin 102, are still isolated from conductive lattice 12 where adjacent inner surfaces 14 remain unpopulated and are held in place by the top and bottom substrates 26 and 34.

DETAILED DESCRIPTION OF AN ALTERNATIVE EMBODIMENT

Figure 12:
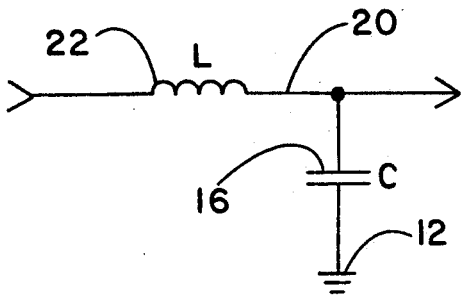
FIG. 12 shows a schematic representation of an LC low-pass filter realized according to an alternative embodiment of the invention.

In an alternative embodiment, a second module 10 comprising a variety of filter circuits providing EMI/RFI protection can be realized between pins 20 and conductive lattice 12 via spring member 32 and conductive strip 33 using appropriate integrated circuit dies 16, such as resistors, capacitors, diodes and other electrical components. Referring to FIG. 1, pin 20 is shown as including a component segment 22 in series between male portion 24 and female portion 28. Component segment 22 may be a resistor, a diode, a capacitor, an inductor or a fuse link. In creating an EMI/RFI filter, segment 22 may be an inductor in the form of a ferrite sleeve physically disposed around pin 20. The combination of a series inductor as segment 22 in combination with integrated circuit dies 16 comprising a monolithic capacitor, serving as a shunt and operatively coupled between pin 20 and ground formed by conductive lattice 12, creates an LC low-pass filter for routing high frequency electromagnetic interference (EMI) and radio frequency interference (RFI) as schematically shown in FIG. 12 to ground via pin 20, spring member 32, conductive strip 33 and conducive members 40 and 42 of lattice 12.

In yet another alternative embodiment, segment 22 comprises a fusible link to provide overcurrent protection to a circuit directly or indirectly coupled to pin 20.

One skilled in the art will quickly realize the versatility of connector module 10 and realize other advantageous circuits that can be integrally formed in a highly compact package using the versatile structure of the invention. Segment 22 can also comprise a plurality of different electrical components in series designed in combination with a plurality of integrated circuit dies 16 to form several different circuits, each circuit formed between pin 20 and the respective inner walls 14 of conductive members 40 and 42, respectively.

This invention has been described in this application in considerable detail in order to comply with the Patent Statutes and to provide those skilled in the art with the information needed to apply the novel principles and to construct and use such specialized components as are required. However, it is to be further understood that the invention can be carried out by specifically different equipment and devices and that various modifications, both as to equipment details and operating procedures, can be accomplished without departing from the scope of the invention itself.

I claim:

1. An electrical connector module, comprising:

(a) a conductive lattice including a plurality of intersecting substrate strips defining a plurality of orifices, each orifice defined by a plurality of facing walls of the lattice;

(b) a plurality of integrated circuit dies each having a first surface conductivity affixed to and disposed on selected ones of said facing walls of predetermined ones of said plurality of orifices and a conductive second surface generally opposite said first surface;

(c) a plurality of contact pins received in predetermined ones of said orifices;

(d) a plurality of conductive interfacing means for establishing an electrical path from said pins to said second surface of said integrated circuit dies; and (e) a conductive housing coupled to a periphery of said conductive lattice.

2. The electrical connector module of claim 1 wherein said conductive lattice and said conductive housing form a ground plane and a heat sink.

3. The electrical connector module of claim 1 wherein said conductive interfacing means comprises a substantially soft conductive metal.

4. The electrical conductor module of claim 1 wherein at least one of said plurality of dies comprises an electrical component forming said electrical path between said conductive interfacing means and said conductive lattice.

5. The electrical connector module of claim 4 wherein at least one said die comprises a diode to form an overvoltage protection filter.

6. The electrical connector module of claim 4 wherein at least one said plurality of contact pins includes at least one segment comprised of an electrical component.

7. The electrical connector module of claim 6 wherein said component segment comprises a fuse to provide overcurrent protection.

8. The electrical connector module of claim 6 wherein a combination of at least one of said component segments and at least one said dies comprise an electrical filter.

9. The electrical connector module of claim 8 wherein said component segment comprises an inductor and at least one said dies comprises a capacitor to form an LC filter.

10. The electrical connector module of claim 1 wherein said conductive interfacing means comprises a conductive spring member biasing said pin away from said die.

11. The electrical connector module of claim 10 wherein said conductive spring member has a pair of distal ends and an opening defined about a midsection thereof, wherein said opening receives said contact pin.

12. The electrical connector module of claim 11 wherein said contact pin includes an arcuate groove for positionally aligning said opening of conductive spring member with said contact pin.

13. The electrical connector module of claim 11 wherein said conductive spring member further includes a pair of elongated apertures each individually defined between said opening and each said distal ends.

14. The electrical connector module of claim 10 wherein said conductive interfacing means further includes a conductive strip disposed between said conductive spring member and at least one said die.

15. The electrical connector module of claim 14 wherein said conductive strip physically engages said dies such that an electrical and thermally conductive path is established from said contact pin to each of said dies engaging said conductive strip.

16. The electrical connector module of claim 1 wherein said conductive lattice comprises a generally rectangular pattern of parallel, spaced-apart strips intersecting to form said orifices.

17. The electrical connector module of claim 16 wherein said generally rectangular lattice comprises a first and second plurality of generally parallel and generally rectangular strips each having a first and second plurality of transverse notches, respectively, wherein said second plurality of generally parallel, generally rectangular strips having said second plurality of transverse notches intersect generally perpendicular to said first plurality of generally parallel strips such that said first plurality of notches securingly and conductively intersect said second plurality of notches to form said rectangular lattice.

18. The electrical connector module of claim 17 wherein an intersecting surface of each of said first and second plurality of generally parallel strips are plated with a substantially conductive material to create a low impedance and high thermal conductive path when intersected.

19. The electrical connector module of claim 18 wherein said module has pin spacing of said contact pins such that said module is connectable with an ARINC 600 receptacle.

* * * * *